US009181708B1

(12) United States Patent
Girgis

(10) Patent No.: US 9,181,708 B1
(45) Date of Patent: Nov. 10, 2015

(54) SNOW REMOVAL SYSTEM

(71) Applicant: Wagih S. Girgis, Belleair Bluffs, FL (US)

(72) Inventor: Wagih S. Girgis, Belleair Bluffs, FL (US)

( * ) Notice: Subject to any disclaimer, the term of this patent is extended or adjusted under 35 U.S.C. 154(b) by 89 days.

(21) Appl. No.: 14/184,403

(22) Filed: Feb. 19, 2014

(51) Int. Cl.
*E04D 13/10* (2006.01)

(52) U.S. Cl.
CPC ..... *E04D 13/106* (2013.01); *E04D 13/103* (2013.01)

(58) Field of Classification Search
CPC ..... E01H 5/10; E04D 7/02; E04D 13/10; E04D 13/103; E04D 13/106; E04D 13/17; E04D 13/076; E04D 13/0762; H05B 3/00; H05B 3/36; H05B 3/342; H05B 2214/02
USPC ..... 37/196, 197, 219, 227–229, 266, 268; 219/213, 528, 548; 52/24
See application file for complete search history.

(56) References Cited

U.S. PATENT DOCUMENTS

| | | | | | |
|---|---|---|---|---|---|
| 3,431,972 | A * | 3/1969 | Bernardi | 165/47 |
| 3,784,783 | A * | 1/1974 | Gray | 219/213 |
| 3,982,360 | A * | 9/1976 | Newman | 52/22 |
| 4,024,654 | A * | 5/1977 | Snyder | 37/268 |
| 4,249,767 | A * | 2/1981 | Andreasen | 294/54.5 |
| 4,291,673 | A * | 9/1981 | Deutz | 126/569 |
| 5,786,563 | A * | 7/1998 | Tiburzi | 219/213 |
| 5,930,457 | A * | 7/1999 | Tourangeau | 392/435 |
| 6,166,352 | A * | 12/2000 | Turton | 219/213 |
| 6,853,804 | B2 * | 2/2005 | Whitinger | 392/488 |
| 6,875,954 | B2 * | 4/2005 | DeBenedetto et al. | 219/213 |
| D514,209 | S * | 1/2006 | Evans et al. | D23/314 |
| 8,440,940 | B2 * | 5/2013 | Backe | 219/213 |

* cited by examiner

*Primary Examiner* — Robert Pezzuto

(57) ABSTRACT

A module assembly includes a forward module, a rearward module, and a hinge coupling the forward module and the rearward module. A movement assembly includes two forward wheels and two rearward wheels. A blower assembly includes a forward auger within the forward module, a rearward auger within the rearward module, an opening in each of the modules with a suction fan rotatable within the opening, and an exhaust tube extending upwardly and outwardly from each of the modules. A drive assembly includes a motor for each of the augers, each of the suction fans, and each of the wheels, and includes a source of electrical potential to power each of the motors.

10 Claims, 6 Drawing Sheets

FIG. 5
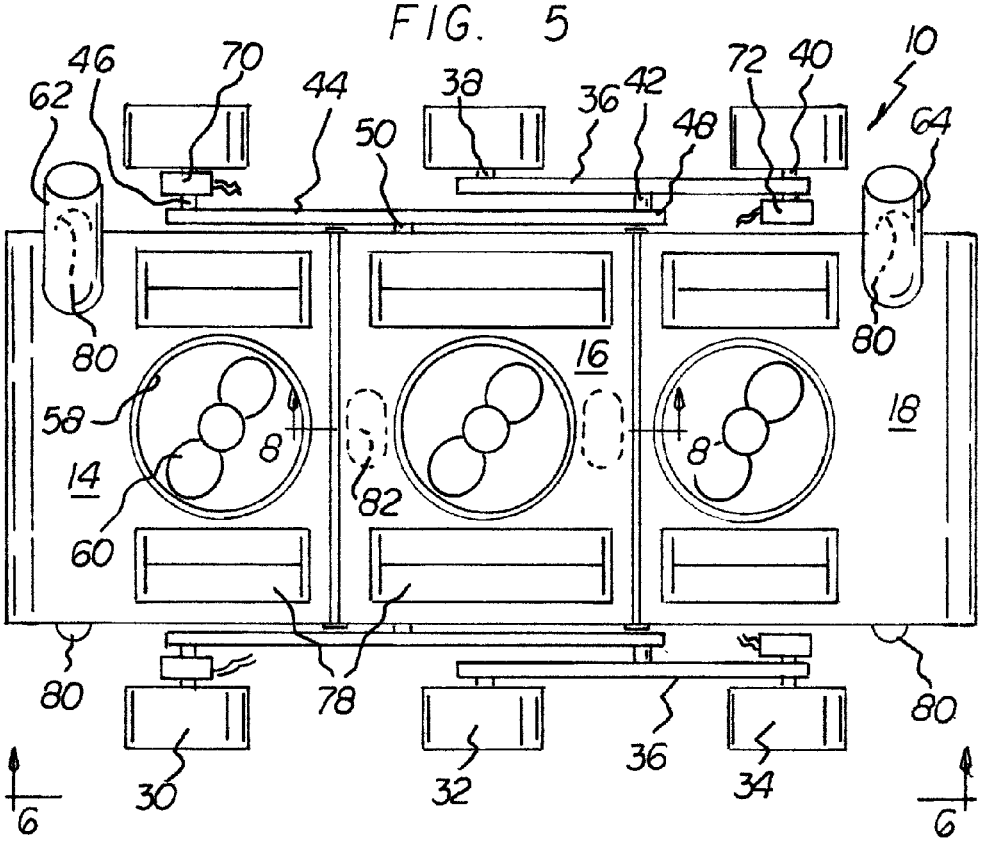
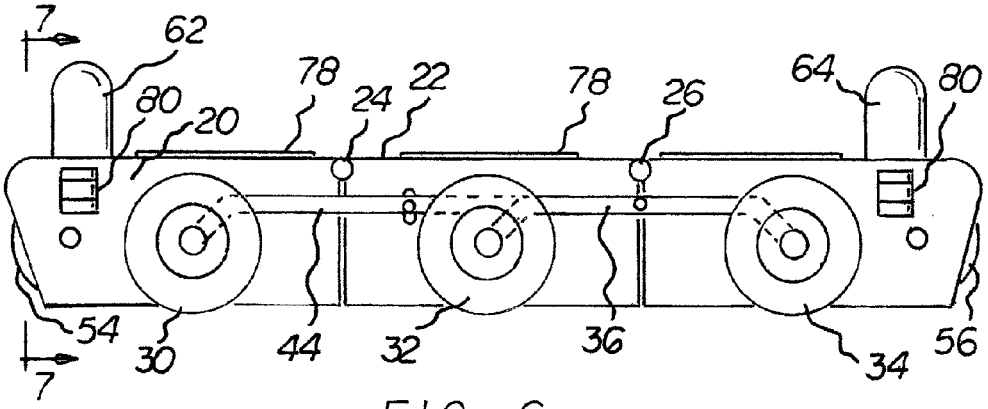
FIG. 6

FIG. 7
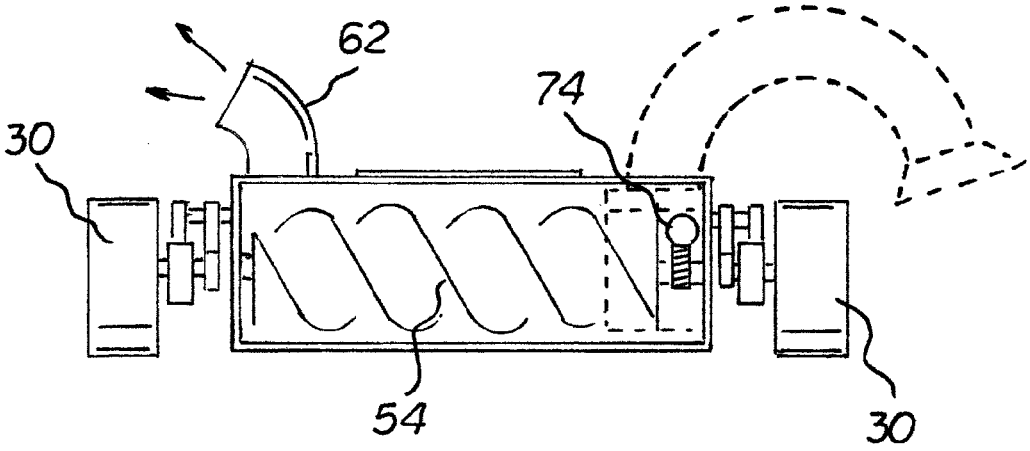
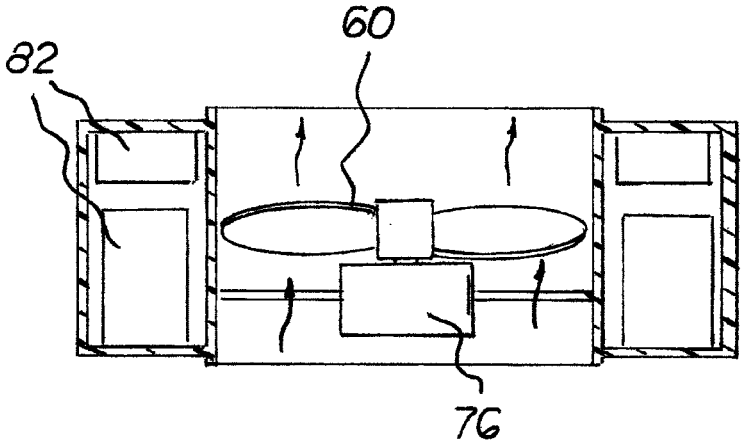
FIG. 8

FIG. 11
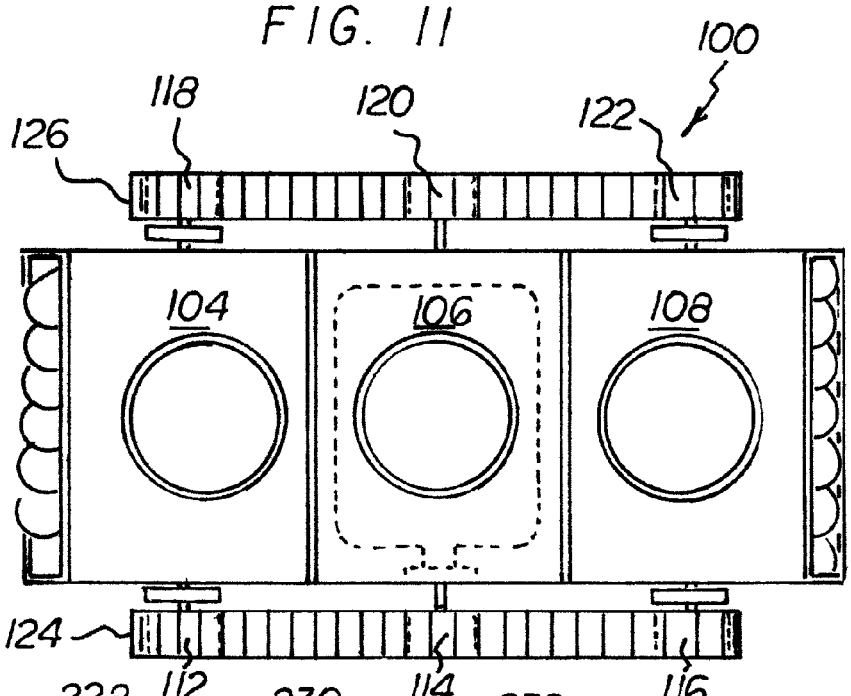
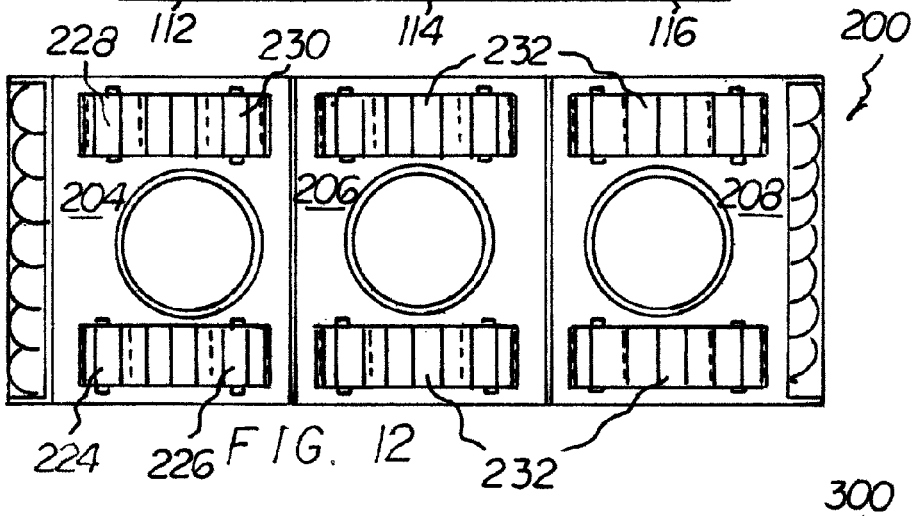
FIG. 12
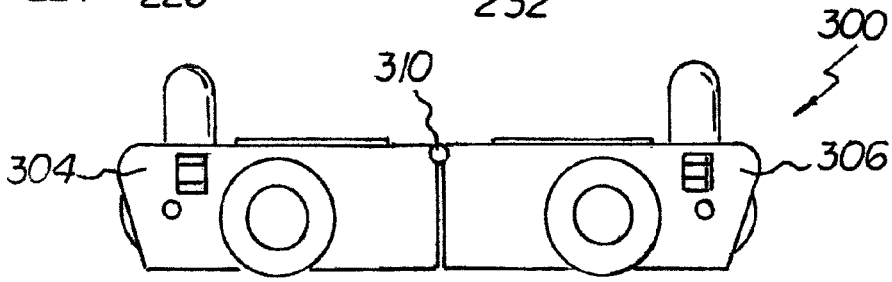
FIG. 13

SNOW REMOVAL SYSTEM

BACKGROUND OF THE INVENTION

1. Field of the Invention

The present invention relates to a snow removal system and more particularly pertains to moving a system over a roof covered with snow and blowing the snow from the roof, the moving and blowing being done in a safe, convenient and economical manner.

2. Description of the Prior Art

The use of snow removal systems of known designs and configurations is known in the prior art. More specifically, snow removal systems of known designs and configurations previously devised and utilized for the purpose of removing snow from a roof of a building are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a snow removal system that allows moving a system over a roof covered with snow and blowing the snow from the roof, the moving and blowing being done in a safe, convenient and economical manner.

In this respect, the snow removal system according to the present invention substantially departs from the conventional concepts and designs of the prior art, and in doing so provides an apparatus primarily developed for the purpose of moving a system over a roof covered with snow and blowing the snow from the roof.

Therefore, it can be appreciated that there exists a continuing need for a new and improved snow removal system which can be used for moving a system over a roof covered with snow and blowing the snow from the roof. In this regard, the present invention substantially fulfills this need.

SUMMARY OF THE INVENTION

In view of the disadvantages inherent in the known types of snow removal systems of known designs and configurations now present in the prior art, the present invention provides an improved snow removal system. As such, the general purpose of the present invention, which will be described subsequently in greater detail, is to provide a new and improved snow removal system and method which has all the advantages of the prior art and none of the disadvantages.

To attain this, the present invention essentially comprises a module assembly including a forward module, a rearward module, and a hinge coupling the forward module and the rearward module. A movement assembly includes two forward wheels and two rearward wheels. A blower assembly includes a forward auger within the forward module, a rearward auger within the rearward module, an opening in each of the modules with a suction fan rotatable within the opening, and an exhaust tube extending upwardly and outwardly from each of the modules. A drive assembly includes a motor for each of the augers, each of the suction fans, and each of the wheels, and includes a source of electrical potential to power each of the motors.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snow removal system which has all of the advantages of the prior art devices and none of the disadvantages.

It is another object of the present invention to provide a new and improved snow removal system which may be easily and efficiently manufactured and marketed.

It is further object of the present invention to provide a new and improved snow removal system which is of durable and reliable constructions.

An even further object of the present invention is to provide a new and improved snow removal system which is susceptible of a low cost of manufacture with regard to both materials and labor, and which accordingly is then susceptible of low prices of sale to the consuming public, thereby making such snow removal system economically available to the buying public.

Lastly, another object of the present invention is to provide a snow removal system for moving a system over a roof covered with snow and blowing the snow from the roof, the moving and blowing being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a plan view of an articulating system constructed in accordance with the principles of the present invention.

FIG. 6 is a side elevational view taken along line 6-6 of FIG. 5.

FIG. 7 is a rear elevational view taken along line 7-7 of FIG. 6.

FIG. 8 is a cross sectional view taken along line 8-8 of FIG. 5.

FIG. 11 is a plan view of the articulating module of FIG. 10.

FIGS. 12 and 13 are elevational views similar to FIG. 11 but illustrating an articulating system constructed in accordance with alternate embodiments of the invention.

The same reference numerals refer to the same parts throughout the various Figures.

DESCRIPTION OF THE PREFERRED EMBODIMENT

Figure 1:
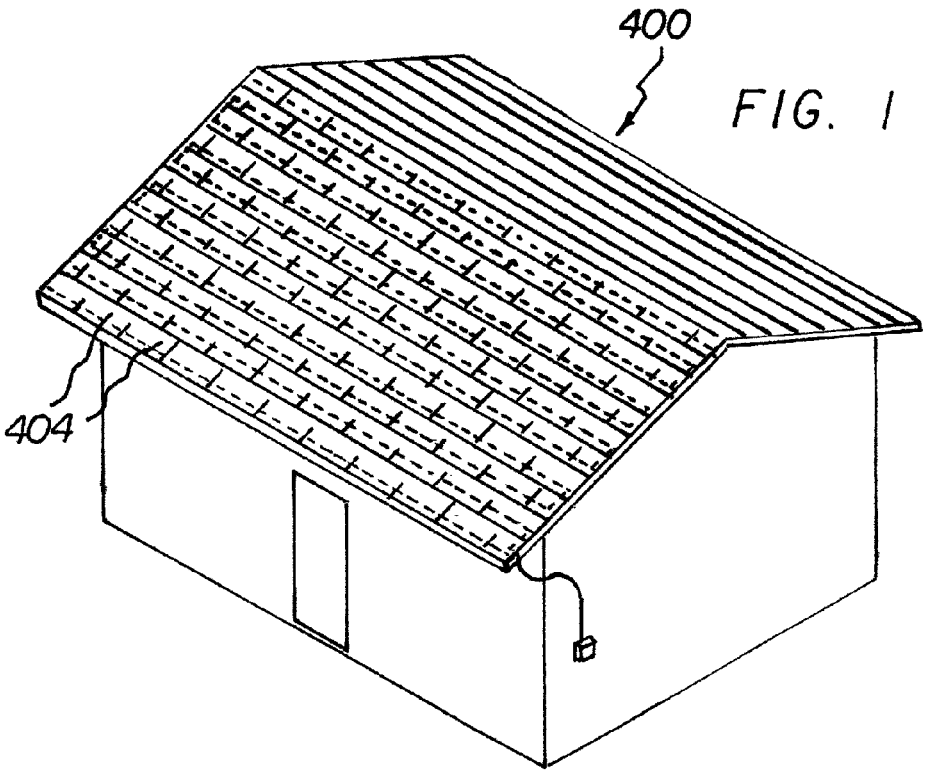
FIG. 1 is perspective illustration of a building with a roof constructed in accordance with the principles of the present invention.

With reference now to the drawings, and in particular to FIG. 1 thereof, the preferred embodiment of the new and improved snow removal system embodying the principles and concepts of the present invention and generally designated by the reference numeral 10 will be described.

The present invention, the snow removal system 10 is comprised of a plurality of components. Such components in their broadest context include a module assembly, a movement assembly, a blower assembly and a drive assembly. Such components are individually configured and correlated with respect to each other so as to attain the desired objective.

The snow removal system 10 of the present invention is for moving over a roof covered with snow and for blowing the snow from the roof. The moving and blowing is done in a safe, convenient and economical manner. First provided is a module assembly. The module assembly includes a forward module 14 forming a forward chamber and having a front end and a rear, side plates 20 being laterally spaced, an open bottom, and a top plate 22. The module assembly further includes a central module 16 forming a central chamber and having a front end and a rear, side plates 20 being laterally spaced, an open bottom, and a top plate 22. The module assembly further includes a rearward module 18 forming a rearward chamber and having a front end and a rear, side plates 20 being laterally spaced, an open bottom, and a top plate 22. The module assembly further has a forward horizontal hinge 24 coupling the forward module and the central module between the upper plate of the forward module and the upper plate of the central module. The module assembly further has a rearward horizontal hinge 26 coupling the central module and the rearward module between the upper plate of the central module and the upper plate of the rearward module.

Next provided is a movement assembly. The movement assembly includes two forward wheels 30 in axial alignment laterally spaced from the side plates of the forward module. The movement assembly further includes two central wheels 32 in axial alignment laterally spaced from the side plates of the central module. The movement assembly further includes two rearward wheels 34 in axial alignment laterally spaced from the side plates of the rearward module. The movement assembly has two short articulation arms 36 laterally spaced from the side plates of the central module and the side plates of the rearward module.

Each of the short articulation arms has a forward end 38 rotatably supporting one of the central wheels. Each of the short articulation arms has a rearward end 40 rotatably supporting one of the rearward wheels. Each of the short articulation arms has a central pivot point 42 adjacent to the rearward horizontal hinge.

The movement assembly has two long articulation arms 44 laterally spaced from the side plates of the central module and the side plates of the forward module. Each of the two long articulation arms has a forward end 46 rotatably supporting one of the forward wheels. Each of the two long articulation arms has a rearward end 48 rotatably supporting one of the short articulation arms. Each of the two long articular arms has a central pivot point 50 adjacent to the forward horizontal hinge.

Next provided is a blower assembly. The blower assembly includes a forward auger 54 within the chamber of the forward module rotatably supported by the side plates of the forward module. The blower assembly further includes a rearward auger 56 within the chamber of the rearward module rotatably supported by the side plates of the rearward module. A circular opening 58 is provided in each of the top plates. A suction fan 60 is provided within each circular opening and is rotatable. The blower assembly also includes a forward exhaust tube 62 extending upwardly and outwardly from the top plate of the forward module. A rearward exhaust tube 64 extends upwardly and outwardly from the top plate of the rearward module. The circular openings 58, the suction fans 60, the forward auger 54, the rearward auger 56, the forward exhaust tube 62, and rearward exhaust tube 64 are adapted to create a path for the flow of air and snow during operation and use.

Next, a drive assembly is provided. The drive assembly includes a forward wheel motor 70 for each of the forward wheels, a rearward wheel motor 72 for each of the rearward wheels, an auger motor 74 for the forward auger 54, an auger motor 74 for the rearward auger 56, and a fan motor 76 for each of the suction fans 60. Solar panels 78 on each of the top plates 22 are provided to power each of the fan motors, each of the auger motors 74 and to independently power each of the wheel motors 70, 72.

A location sensor 80 is provided. The location sensor extends laterally from the side panels of the forward module and the side panels of the rearward module to determine the location of the system with respect to a roof over which the system is moving.

Lastly, in the preferred embodiment, computer controls 82 are provided. The computer controls are in the central module and are operatively coupled between the location sensors 80 and the forward wheel motor 70 and rearward wheel motor 72 for activating and inactivating the wheel motors to move the system and to preclude movement of the system off of the roof. In an alternate embodiment of the invention, remote controls are adapted to be used as a substitute for the location sensors.

Figure 2:
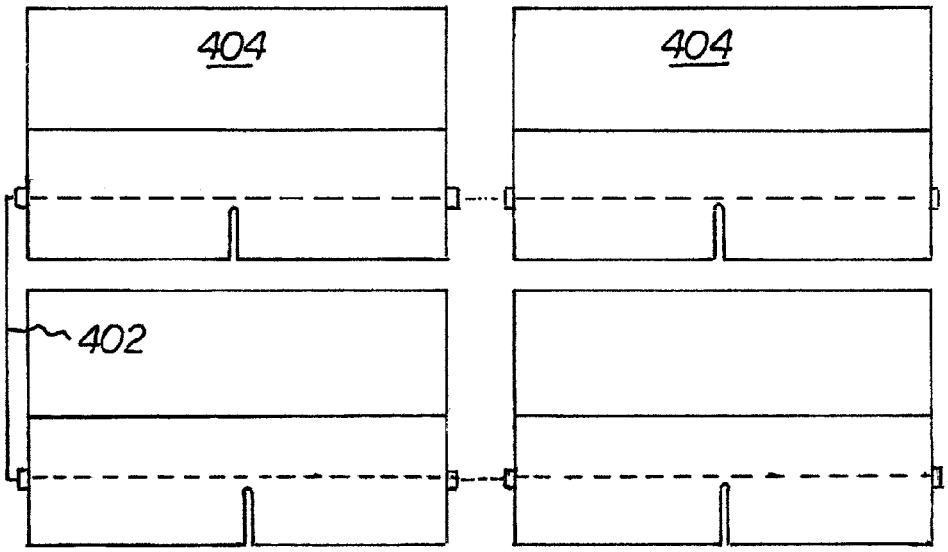
FIG. 2 is an exploded perspective illustration of four contiguous shingles of the roof shown in FIG. 1.
Figure 3:
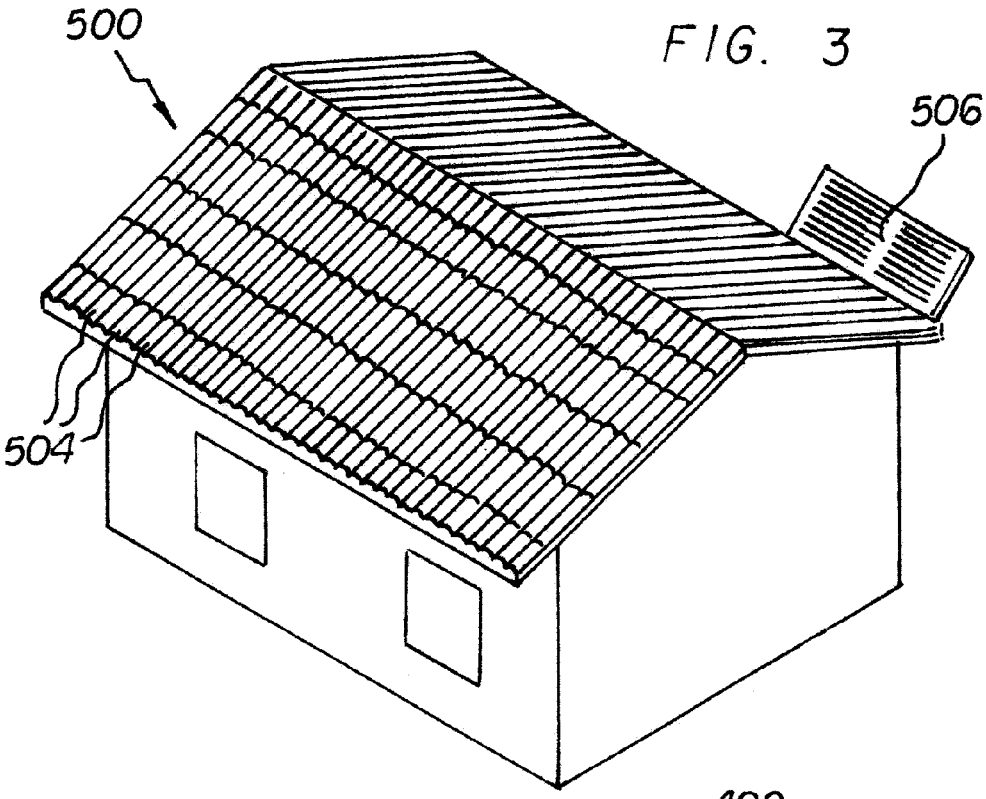
FIG. 3 is perspective illustration of a building with a roof constructed with tiles in accordance with the principles of the present invention.
Figure 4:
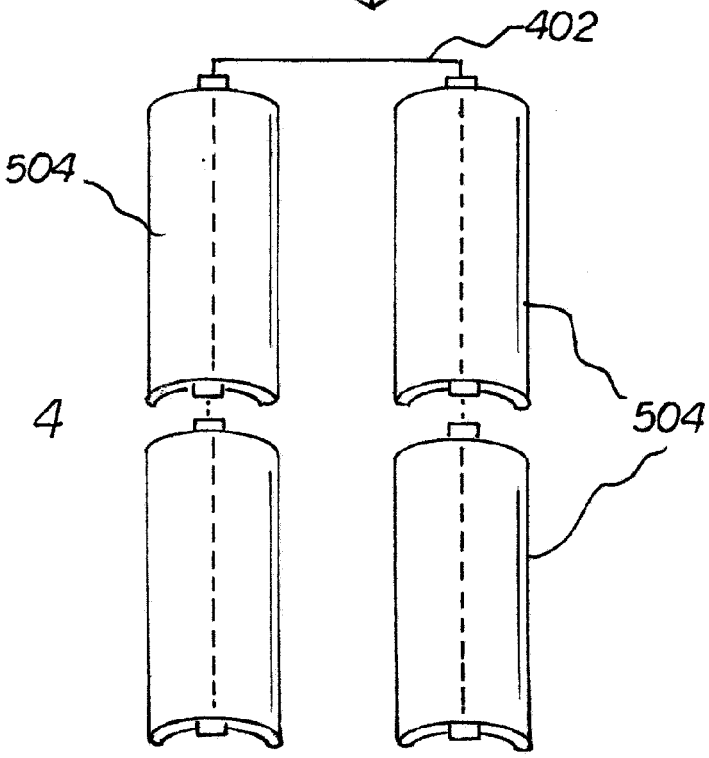
FIG. 4 is an exploded perspective illustration of four contiguous tiles of the roof shown in FIG. 3.
Figure 9:
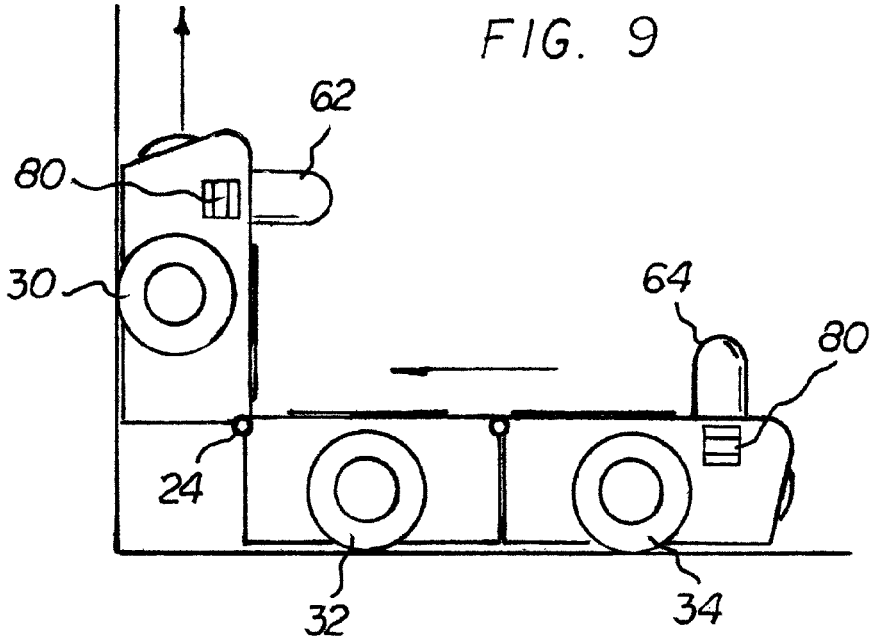
FIG. 9 is a side elevational view similar to FIG. 6 but illustrating the articulating module traveling around a bend.

In an alternate embodiment of the invention, roof components are provided. Electrical resistance wires are within the roof components. A source of electrical potential is provided to power the electrical resistance wires 402 and roof components for heating the electrical resistance wires and the roof components to melt snow on the roof components. Note FIGS. 1 and 2 wherein the roof components of the system 400 are shingles 404. In FIGS. 3 and 4, the roof components of the system 500 are tiles 504. In this embodiment, the source of electrical potential includes a solar panel 506.

In another alternate embodiment, an electrical cord 86 with prongs 88 is adapted to be coupled to an electrical receptacle for powering the system. The system also includes a take-up reel on one of the modules for removably receiving the electrical cord.

Figure 10:
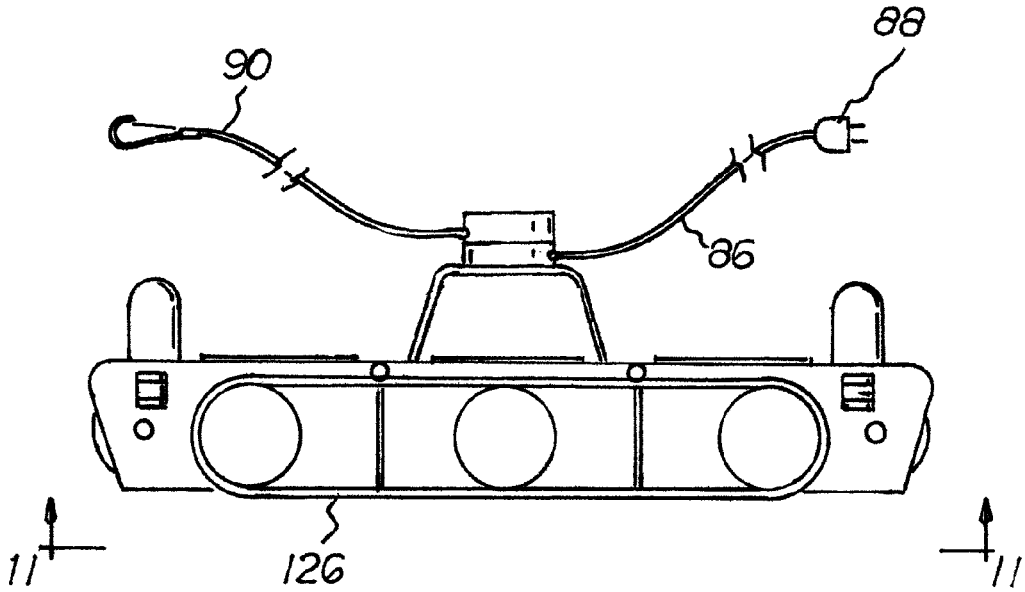
FIG. 10 is a side elevational view similar to FIG. 6 but illustrating an articulating modules constructed in accordance with an alternate embodiment of the invention.

As shown in FIG. 10, another embodiment includes a tether cord 90 coupling the system to a roof of a building.

In FIGS. 5, 6, 9 and 10, shown the system wherein the module assembly includes three modules, In still another alternate embodiment, as shown in FIG. 11, the module assembly of the system 100 includes three modules 104, 106, 108. The movement assembly includes three left side wheels 112, 114, 116. The movement assembly also includes three right side wheels 118, 120, 122. A left loop of tracks 124 is provided around the three left side wheels and a right loop of tracks 126 is provided around the three right side wheels.

Another embodiment of the system is shown in FIG. 12. In this embodiment, the module assembly of the system 200 includes three modules 204, 206, 208. The movement assembly includes two left side wheels 224, 226 on each of the modules and two right side wheels 228, 230 on each of the modules. The movement assembly also includes a left loop of tracks 232 around the two left side wheels of each module and a right loop of tracks 232 around the two right side wheel of each of the modules.

Lastly, as shown in FIG. 13, the module assembly of a final embodiment of the system 300 consists of only two modules 304, 306 with a single hinge 310 coupling the two modules.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A snow removal system comprising:

a module assembly including a forward module, a rearward module, and a hinge coupling the forward module and the rearward module;

a movement assembly including two forward wheels and two rearward wheels;

a blower assembly including a forward auger within the forward module, a rearward auger within the rearward module, an opening in each of the modules with a suction fan rotatable within the opening, and an exhaust tube extending upwardly and outwardly from each of the modules; and a drive assembly including a motor for each of the augers, each of the suction fans, and each of the wheels, the drive assembly also including a source of electrical potential to power each of the motors.

2. The system as set forth in claim 1 and further including:

solar panels on each of the modules for powering each of the motors.

3. The system as set forth in claim 1 and further including:

a location sensor extending laterally from the forward and rearward modules to determine the location of the system with respect to a roof over which the system is moving; and computer controls in one of the modules operatively coupled between the location sensors and each of the wheel motors for activating and inactivating each of the wheel motors to preclude movement of the system off of the roof.

4. The system as set forth in claim 1 and further including:

an electrical cord (86) with prongs (88) adapted to be coupled to an electrical receptacle for powering the system, the system also including a take-up reel on one of the modules for removably receiving the electrical cord.

5. The system as set forth in claim 1 and further including:

a tether cord (90) coupling the system to a roof of a building.

6. The system as set forth in claim 1 wherein the module assembly includes three modules.

7. The system (100) as set forth in claim 1 wherein the module assembly includes three modules (104)(106)(108) and the movement assembly includes three left side wheels (112)(114)(116) and three right side wheels (118)(120)(122) and a left loop of tracks (124) around the three left side wheels and a right loop of tracks (126) around the three right side wheels.

8. The system (200) as set forth in claim 1 wherein the module assembly includes three modules (204)(206)(208) and the movement assembly includes two left side wheels (224)(226) on each of the modules and two right side wheels (228)(230) on each of the modules, the movement assembly also including a left loop of tracks (232) around the two left side wheel of each module, the movement assembly also including a right loop of tracks (232) around the two right side wheel of each of the modules.

9. The system (300) as set forth in claim 1 wherein the module assembly consists of only two modules (304)(306) with a single hinge (310) coupling the two modules.

10. A snow removal system (10) for moving over a roof covered with snow and for blowing the snow from the roof, the moving and blowing being done in a safe, convenient and economical manner, the system comprising, in combination:

a module assembly including:

a forward module (14) forming a forward chamber and having a front end and a rear, side plates (20) being laterally spaced, an open bottom, and a top plate (22);

a central module (16) forming a central chamber and having a front end and a rear, side plates (20) being laterally spaced, an open bottom, and a top plate (22); and a rearward module (18) forming a rearward chamber and having a front end and a rear, side plates (20) being laterally spaced, an open bottom, and a top plate (22);

a forward horizontal hinge (24) coupling the forward module and the central module between the upper plate of the forward module and the upper plate of the central module;

a rearward horizontal hinge (26) coupling the central module and the rearward module between the upper plate of the central module and the upper plate of the rearward module;

a movement assembly including:

two forward wheels (30) in axial alignment laterally spaced from the side plates of the forward module;

two central wheels (32) in axial alignment laterally spaced from the side plates of the central module;

two rearward wheels (34) in axial alignment laterally spaced from the side plates of the rearward module;

two short articulation arms (36) laterally spaced from the side plates of the central module and the side plates of the rearward module, each of the short articulation arms having:

a forward end (38) rotatably supporting one of the central wheels;

a rearward end (40) rotatably supporting one of the rearward wheels; and a central pivot point (42) adjacent to the rearward horizontal hinge;

two long articulation arms (44) laterally spaced from the side plates of the central module and the side plates of the forward module; each of the two long articulation arms having:

a forward end (46) rotatably supporting one of the forward wheels;

a rearward end (48) rotatably supporting one of the short articulation arms; and a central pivot point (50) adjacent to the forward horizontal hinge;

a blower assembly including:

a forward auger (54) within the chamber of the forward module rotatably supported by the side plates of the forward module;

a rearward auger (56) within the chamber of the rearward module rotatably supported by the side plates of the rearward module;

a circular opening (58) in each of the top plates with a suction fan (60) rotatable within each circular opening;

a forward exhaust tube (62) extending upwardly and outwardly from the top plate of the forward module;

a rearward exhaust tube (64) extending upwardly and outwardly from the top plate of the rearward module;

the circular openings (58), the suction fans (60), the forward auger (54), the rearward auger (56), the forward exhaust tube (62), and rearward exhaust tube (64) adapted to create a path for the flow of air and snow during operation and use; and a drive assembly including:

a forward wheel motor (70) for each of the forward wheels;

a rearward wheel motor (72) for each of the rearward wheels;

an auger motor (74) for the forward auger (54);

an auger motor (74) for the rearward auger (56);

a fan motor (76) for each of the suction fans (60);

solar panels (78) on each of the top plates (22) to power each of the fan motors, each of the auger motors (74) and to independently power each of the wheel motors (70)(72);

a location sensor (80) extending laterally from the side panels of the forward module and the side panels of the rearward module to determine the location of the system with respect to a roof over which the system is moving; and computer controls (82) in the central module operatively coupled between the location sensors (80) and the forward wheel motor (70) and rearward wheel motor (72) for activating and inactivating the wheel motors to move the system and to preclude movement of the system off of the roof.

* * * * *